US008398171B2

(12) United States Patent
Lin et al.

(10) Patent No.: US 8,398,171 B2
(45) Date of Patent: Mar. 19, 2013

(54) LIFT CHAIR

(75) Inventors: Chia-Chuan Lin, Taichung (TW); Po-Ming Tsai, Taichung (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 160 days.

(21) Appl. No.: 12/930,761

(22) Filed: Jan. 14, 2011

(65) Prior Publication Data

US 2012/0181832 A1 Jul. 19, 2012

(51) Int. Cl.
*A47C 1/00* (2006.01)

(52) U.S. Cl. ..... 297/330; 297/DIG. 10

(58) Field of Classification Search ..... 297/330, 297/DIG. 10
See application file for complete search history.

(56) References Cited

U.S. PATENT DOCUMENTS 3,596,991 A * 8/1971 Mckee et al. ..... 297/330 X
4,007,960 A * 2/1977 Gaffney ..... 297/330 X
4,083,599 A * 4/1978 Gaffney ..... 297/330 X
4,614,246 A * 9/1986 Masse et al. ..... 297/330 X
4,786,107 A * 11/1988 Crockett ..... 297/330
4,802,542 A * 2/1989 Houston et al. .... 297/DIG. 10 X
4,809,804 A * 3/1989 Houston et al. ..... 297/330 X
4,850,645 A * 7/1989 Crockett ..... 297/330
4,852,939 A * 8/1989 Krauska ..... 297/330 X
4,909,569 A * 3/1990 Gaffney ..... 297/330
4,946,222 A * 8/1990 Matson ..... 297/330 X
4,993,777 A * 2/1991 LaPointe ..... 297/330 X
5,024,486 A * 6/1991 Auel ..... 297/330
5,061,010 A * 10/1991 LaPointe ..... 297/330 X
5,136,889 A * 8/1992 Hill et al. ..... 297/330 X
5,137,102 A * 8/1992 Houston et al. ..... 297/330 X
5,165,753 A * 11/1992 Henderson ..... 297/330 X
5,174,167 A * 12/1992 Hill et al. ..... 297/330 X
5,215,351 A * 6/1993 Lapointe ..... 297/330 X
5,294,179 A * 3/1994 Rudes et al. ..... 297/330
5,314,238 A * 5/1994 Komorowski et al. .... 297/330 X
5,320,412 A * 6/1994 Eakins et al. ..... 297/330 X
5,346,280 A * 9/1994 Deumite ..... 297/330
5,466,046 A * 11/1995 Komorowski et al. .... 297/330 X
5,482,350 A * 1/1996 Komorowski et al. . 297/DIG. 10
5,651,580 A * 7/1997 LaPointe et al. ..... 297/330 X
5,661,858 A * 9/1997 House et al. ..... 297/DIG. 10 X
5,730,494 A * 3/1998 LaPointe et al. ..... 297/330
5,803,545 A * 9/1998 Guguin ..... 297/330 X
5,895,093 A * 4/1999 Casey et al. ..... 297/330
5,931,532 A * 8/1999 Kemmerer et al. ..... 297/330 X
5,984,411 A * 11/1999 Galumbeck ..... 297/330 X
5,992,931 A * 11/1999 LaPointe et al. ..... 297/330 X
6,000,758 A * 12/1999 Schaffner et al. .. 297/DIG. 10 X
6,142,568 A * 11/2000 Abelbeck et al. ..... 297/330 X
6,213,554 B1 * 4/2001 Marcoux et al. ..... 297/330
6,637,818 B2 * 10/2003 Williams ..... 297/330
7,090,297 B2 * 8/2006 Mohn et al. ..... 297/330
7,543,885 B2 * 6/2009 Pollard et al. ..... 297/330 X

* cited by examiner

*Primary Examiner* — Rodney B White
(74) *Attorney, Agent, or Firm* — Charles E. Baxley

(57) ABSTRACT

A lift chair includes a seat portion formed therein with an accommodating room that is closed atop by a plane; a cushion deposited on the plane; a lifter mechanism deposited in the accommodating room and having an upper end connected to a bottom of the cushion; and a power source serving to drive the lifter mechanism to operate, thereby lifting or lowering the cushion, horizontally moving the cushion, or tilting the cushion, and in turn assisting a user to stand up or sit down.

4 Claims, 6 Drawing Sheets

LIFT CHAIR

BACKGROUND OF THE INVENTION

1. Technical Field

The present invention relates to assistive technology devices, and more particularly, to a lift chair designed to assist a user to stand up from the chair or sit down into the chair more effortlessly and safely.

2. Description of Related Art

As reported, in the States, over three million people get injured in slipping accidents at home and even the thousand people get killed in such accidents every year. According to the statistical data issued officially in Japan, there are about one million people injured in slipping accidents at home ever year and almost one thousand people get killed so. The victims are most the aged people older than 65.

The aged and disabled usually have difficulty in standing up and sitting down on their own because their degenerative or injured knee joints fail to provide adequate support. Some assistive technology devices have been developed for functioning as a support that helps the aged and disabled to walk, to stand up and to sit down. The existing assistive technology devices usually require the users to raise or lower themselves using their upper limbs to support their bodies. However, physically weak people, particularly the aged, usually also suffer from weak arms and hands, and this fact risks them falling every time they stand up or sit down. Hence, there is a need for an approach to providing assistance in a safer and more effortless way.

SUMMARY OF THE INVENTION

In view that the existing assistive technology devices are not perfect solution for the aged and/or disabled to stand up and sit down safely and effortlessly, the present invention provides a power lift chair that comprises:

a seat portion formed therein an accommodating room, which is atop covered by a plane;

a cushion deposited on the plane;

a lifter mechanism deposited in the accommodating room and having an upper end connected to a bottom of the cushion; and a power source configured to drive the lifter mechanism to operate, thereby lifting or lowering the cushion, horizontally moving the cushion, or tilting the cushion, and in turn assisting a user to stand up or sit down.

One objective of the present invention is to provide the lift chair, wherein the power source drives the lifter mechanism to operate, so as to lift, to lower, to shift or to tilt the cushion in a track meeting the user's bottom moving between a standing position and a sitting position, thereby assisting the user to stand up or sit down under the support from the cushion. With the assistance of the external power, the user can stand up and sit down effortlessly, comfortably and safely.

Another objective of the present invention is to provide the lift chair, wherein the accommodating room has its bottom closed by another plane, so that the lifter mechanism can directly stand on and get supported by a solid plane, such as the ground, thereby properly distributing the user's weight placed on the cushion. Thus, the lift chair of the present invention is more load-bearing.

Still another objective of the present invention is to provide the lift chair, wherein the controller is coupled to a sensor that detects whether the user's bottom is in contact with the cushion and send a sensing signal to the controller so as to prevent the cushion from being prematurely lowered, thereby ensuing the user's safety.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

The following preferred embodiments when read with the accompanying drawings are made to clearly exhibit the above-mentioned and other technical contents, features and effects of the present invention. However, the accompanying drawings are intended for reference and illustration, but not to limit the present invention and are not made to scale. In addition, for the convenience of illustration for the components and connective relations therebetween, in the following desecration, the directions are defined based on a user normally sitting in the chair of the present invention face. For example, where the user's face faces toward is the front.

Figure 1:
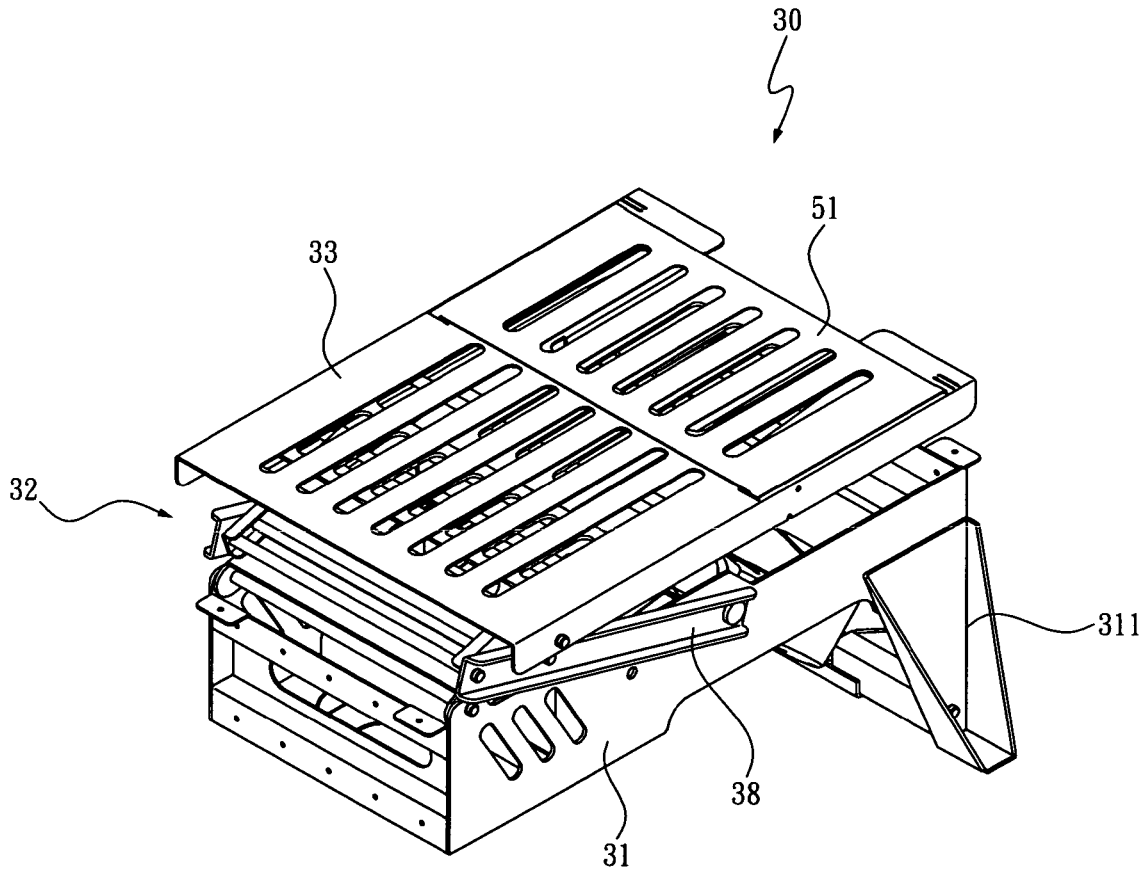
FIG. 1 is a part perspective view of a lift chair of the present invention.
Figure 2:
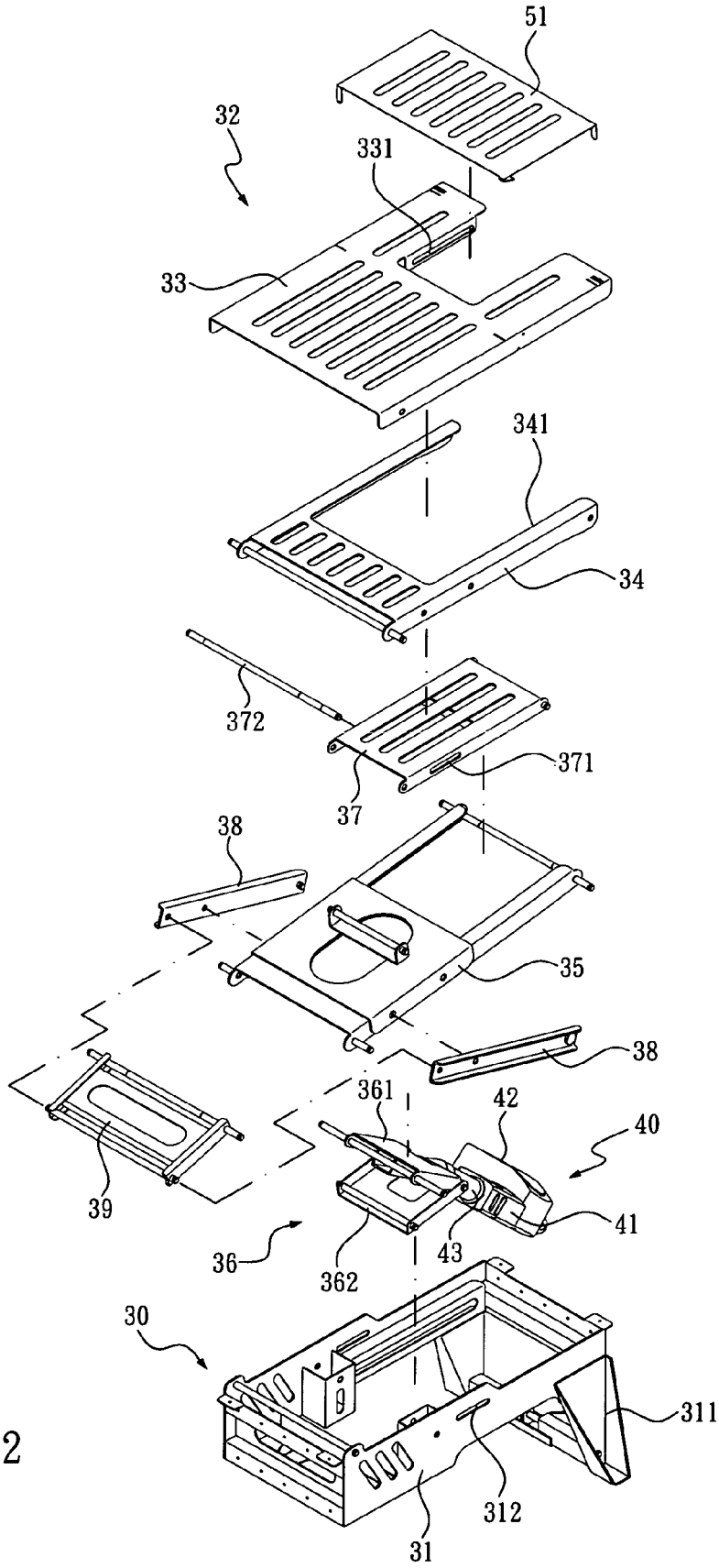
FIG. 2 is a part exploded view of the lift chair of the present invention.
Figure 3:
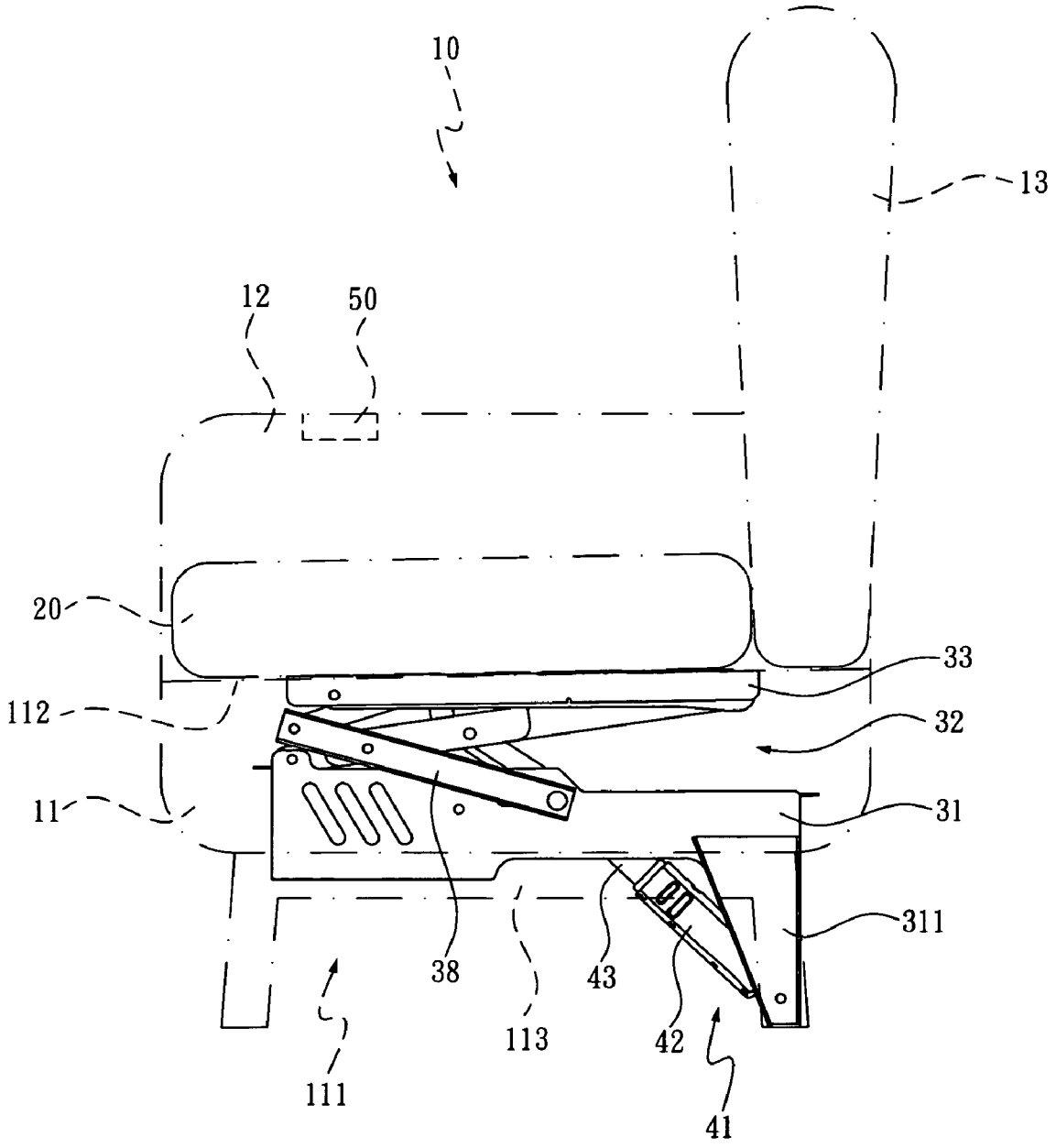
FIGS. 3 to 5 illustrate operation of lift chair of the present invention.
Figure 4:
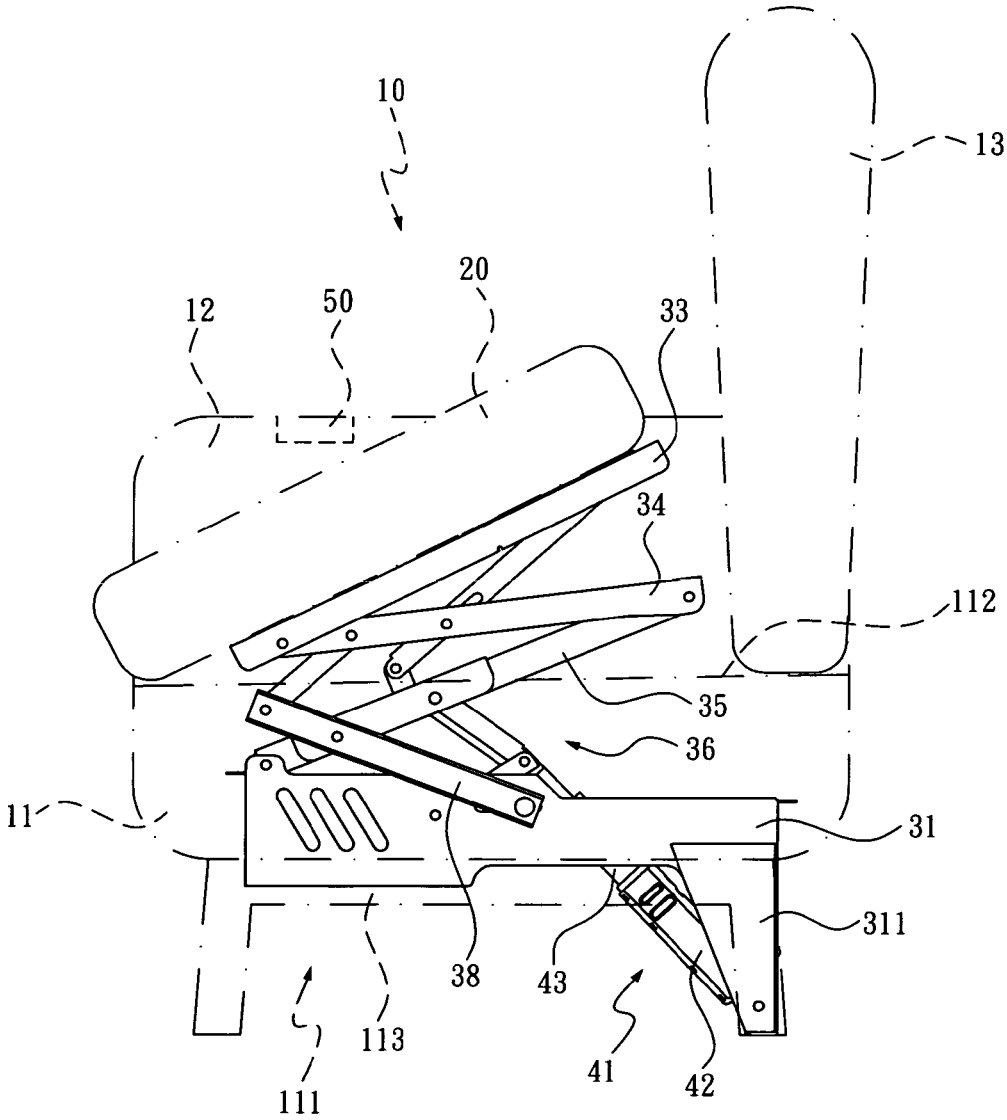
Figure 5:
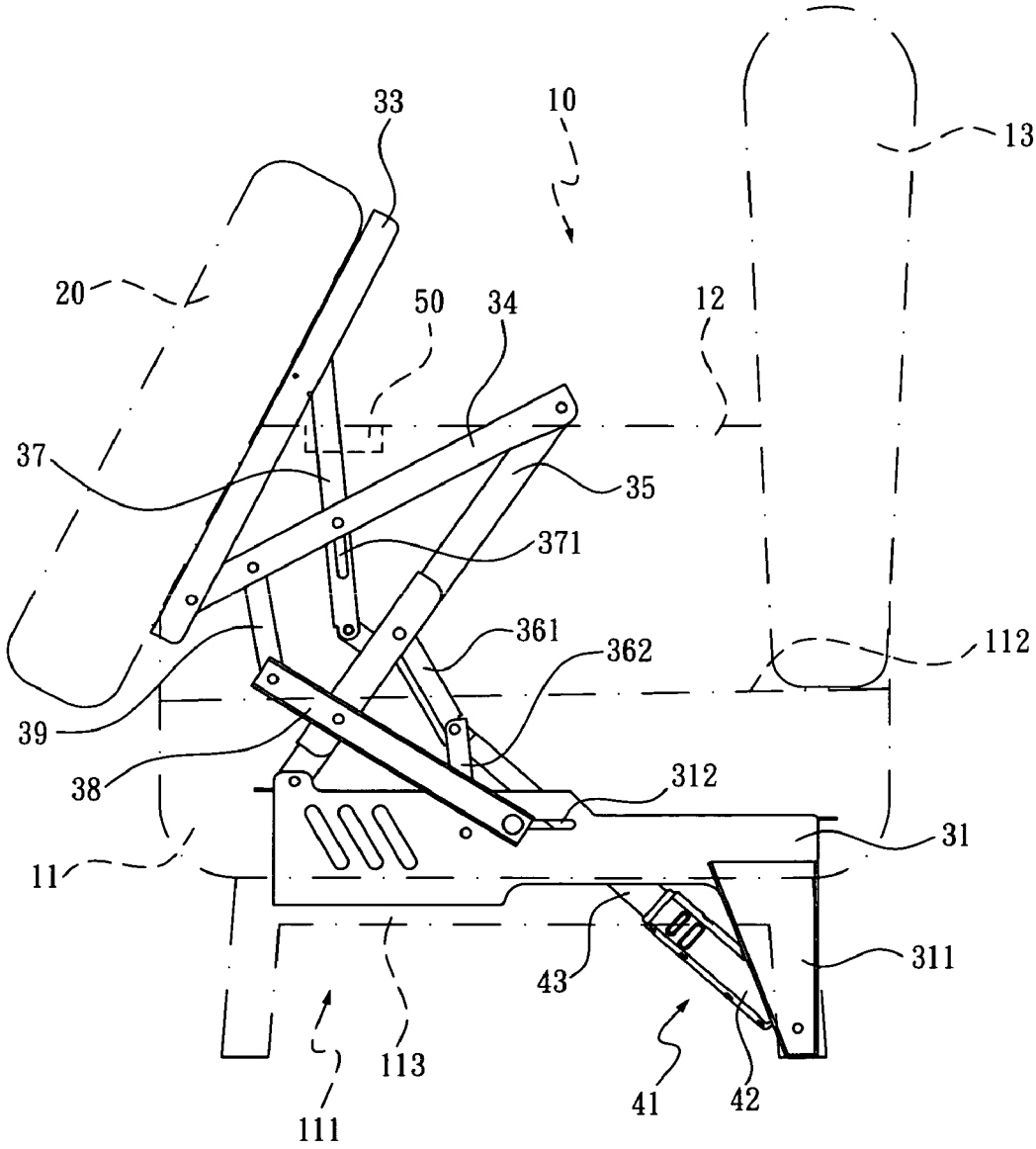
Figure 6:
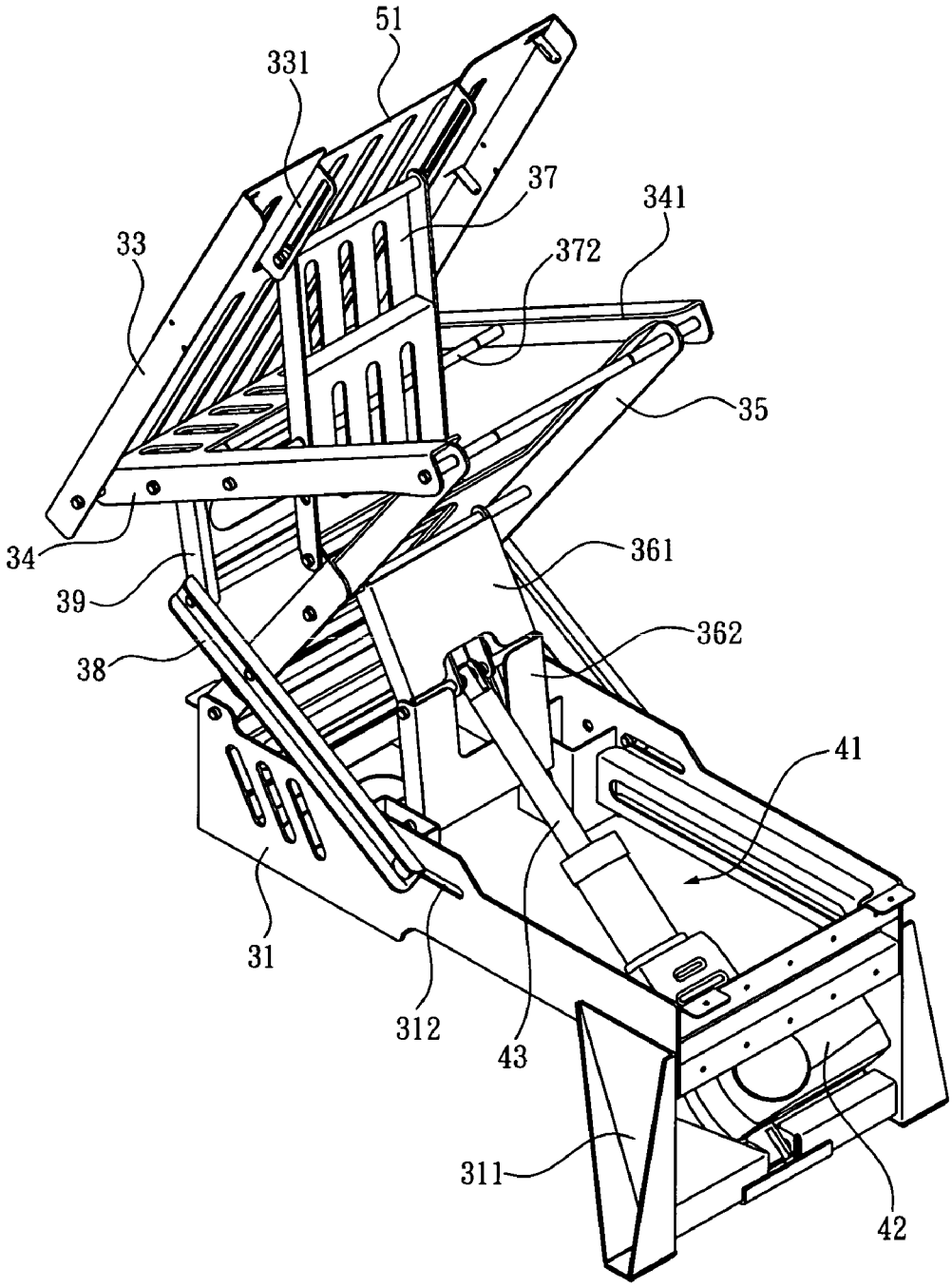
FIG. 6 is also a part perspective view of a lift chair of the present invention.

As shown in FIG. 1 through FIG. 3, the present invention provides a lift chair composed of the components described in detail below.

A seat portion 10 has a chair body 11 that is formed therein an accommodating room 111. The accommodating room 111 is closed atop and at bottom by two planes 112, 113. The chair body 11 is bilaterally provided with armrests 12 on which a user sitting in the chair may rest his/her arms. A chair back 13 is provided at the rear side of the chair body 11 for the user to rest his/her back.

A cushion 20 is deposited on the plane 112 for the user to rest his/her bottom.

A lifter mechanism 30 arranged in the accommodating room 111 has an upper end thereof connected to a bottom of the cushion 20.

A power source 40 is configured to drive the lifter mechanism 30 to operate, so as to lift, to lower, to shift or to tilt the cushion 20 in a track meeting the user's bottom moving between a standing position and a sitting position, thereby assisting the user to stand up or sit down under the support from the cushion 20. Therein, the power source 40 is at least one actuator 41. The actuator 41 comprises a driving portion 42 and an extension rod 43.

The lifter mechanism 30 further comprises the following components.

A base 31 deposited in the accommodating room 111 is in the form of a frame opened both upward and downward. The base 31 has its rear end formed with at least one support leg 311 extending downward. The driving portion 42 of the actuator 41 has one end pivotally connected to the support leg 311. The support leg 311 may pass through the plane 113 below the accommodating room 111 and through the ground. Therein, the base 31 is bilaterally formed with a sliding guide 312.

A plate set 32 is provided on the base 31 and comprises from top to bottom an upper plate 33, a middle plate 34 and a lower plate 35. The lower plate 35 has its front end pivotally connected to the front end of the base 31. The middle plate 34 and the lower plate 35 have their rear ends pivotally connected to each other while the upper plate 33 and the middle plate 34 have their front ends pivotally connected to each other. Therein, the middle plate 34 is formed with an opening 341. The upper plate 33 has its bottom formed with two parallel rails 331 near the rear end thereof. The upper plate 33 has its upper surface connected to the bottom of the cushion 20.

A hinge assembly 36 is composed of an upper part 361 and a lower part 362. Each of the upper part 361 and the lower part 362 has one end pivotally connected to the extension rod 43 of the actuator 41. The upper part 361 has an opposite end pivotally connected to the middle bottom of the lower plate 35, while the lower part 362 has an opposite end pivotally connected to the middle portion of the base 31.

A turning board 37 has one end pivotally connected to the middle portion of the upper surface of the lower plate 35, and an opposite end passing through the opening 341 of the middle plate 34 to be slidably received in the rails 331. The turning board 37 is bilaterally formed with a slot 371. The slots 371 are such configured that a rod 372 is allowed to pass therethrough and then pivotally connected to the middle portion of the middle plate 34.

Two sliding shanks 38 are provided. Each of the sliding shanks 38 has one end slidably received in the corresponding sliding guide 312, and has its middle portion pivotally connected to the corresponding lateral of the lower plate 35.

A front board 39 has one end pivotally connected to the sliding shanks 38 opposite to the base 31, and an opposite end such pivotally connected to the middle plate 34 that the joint of the front board 39 and the middle plate 34 is located between the joints where the middle plate 34 joins the rod 372 and the upper plate 33, respectively.

A controller 50 is deposited on at least one of the armrests 12. The controller 50 provides a plurality of keys or switches for controlling the lifter mechanism 30. In addition, the controller 50 is coupled with a sensor 51 deposited on the upper plate 33. The sensor 51 may be realized by a micro switch, a press detection switch, a photo interrupter or any other device providing the required sensing function by detecting whether the user's bottom is in contact with the cushion 20, and sending a sensing signal to the controller 50.

Basing on the configuration of the present invention as described above, the operation of the present invention and the principles on which the operation is established are explained in detail below.

Referring to FIG. 3 through FIG. 6, when the user operates the controller 50 to lift the cushion 20 for helping the user to stand up from the seat portion 10, the controller 50 drives the driving portion 42 of the actuator 41 to extend the extension rod 43.

When the extension rod 43 extends and becomes longer in length, the upper part 361 and the lower part 362 of the hinge assembly 36 are pushed and expand, thereby driving the lower plate 35 to turn forward. Then the linkage among the turning board 37, the sliding shanks 38 and the front board 39 of the lifter mechanism 30 makes the upper plate 33 and the middle plate 34 to turn and move correspondingly, so as to drive the cushion 20 to operate, so as to lift and tilt the cushion 20 in a track meeting the user's bottom moving from a sitting position to a standing position, thereby assisting the user to stand up from the seat portion 10 with proper support through the whole course. With this assistance, the user can stand up safely and effortlessly.

When the user wants to sit down in the seat portion 10, he/she can also operate the controller 50 to make the mechanism operate reversely, so as to lower the cushion 20, thereby assisting the user to sit down into the seat portion 10 with proper support through the whole course. With this assistance, the user can be secured from falling.

Considering that the aged and disabled having weak knee joints when sitting down can often fear when their bottoms are suspending without support, according to the present invention, when the cushion 20 is lifted to the standing position, the cushion 20 is posed to be right behind the bottom of the standing user, so that the standing user can be supported by slightly leaning backward. Thereby, the user can be comfortably seated without danger and fear.

For preventing the controller 50 from prematurely triggered before the user's bottom touches the cushion 20, the sensor 51 coupled to the controller 50 may serve to detect whether the user's bottom is in contact with the cushion 20. Thereby, when the user operates the controller 50 and the bottom well contacts the cushion 20, the controller 50 operates to lower the cushion 20, so as to prevent premature lowering and related accidents.

Additionally, the chair body 11, the armrests 12, the chair back 13 and the cushion 20 of the seat portion 10 are not much different from the general furniture parts, so a manufacturer can produce the lift chair of the present invention by slightly modifying the existing production line and furniture parts to add the lifter mechanism 30 and other components, thereby minimizing additional investment for hardware.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A lift chair, comprising:

a seat portion formed therein with an accommodating room having a top closed by a plane;

a cushion deposited on the plane;

a lifter mechanism deposited in the accommodating room and having an upper end connected to a bottom of the cushion; and a power source configured to drive the lifter mechanism to operate, so as to lift, to lower, to shift or to tilt the cushion in a track meeting a bottom of a user moving between a standing position and a sitting position, thereby assisting the user to stand up or sit down under support of the cushion;

wherein the seat portion has a chair body in which the accommodating room is formed, the chair body being bilaterally provided with armrests for the user to rest his/her arms, a controller being deposited on at least one of the armrests for controlling the lifter mechanism, and a chair back being provided at a rear side of the chair body for the user to rest his/her back;

wherein the power source includes at least one actuator that comprises a driving portion and an extension rod; and wherein the lifter mechanism comprises:

a base being pivotally connected with one end of the driving portion of the actuator and bilaterally formed with a sliding guide;

a plate set being provided on the base and comprising from top to bottom an upper plate, a middle plate and a lower plate, the lower plate having a front end pivotally connected to a front end of the base, the middle plate and the lower plate having rear ends thereof pivotally connected to each other, and the upper plate and the middle plate having front ends thereof pivotally connected to each other, wherein the middle plate has an opening while the upper plate has a bottom formed with two parallel rails and an upper surface connected to the bottom of the cushion;

a hinge assembly having an upper part and a lower part, each of the upper part and the lower part having one end pivotally connected to the extension rod of the actuator, the upper part having an opposite end pivotally connected to a middle bottom of the lower plate, and the lower part having an opposite end pivotally connected to a middle portion of the base;

a turning board having one end pivotally connected to a middle portion of an upper surface of the lower plate and an opposite end passing through the opening of the middle plate to be slidably received in the rails, the turning board being bilaterally formed with a slot, the slots being so configured that a rod is allowed to pass therethrough and then pivotally connected to a middle portion of the middle plate;

two sliding shanks each having one end slidably received in the corresponding sliding guide, and having a middle portion pivotally connected to a corresponding lateral of the lower plate; and a front board having one end pivotally connected to the sliding shanks opposite to the base, and an opposite end so pivotally connected to the middle plate that a joint of the front board and the middle plate is located between joints where the middle plate joins the rod and the upper plate, respectively.

2. The lift chair of claim 1, wherein the base has a rear end formed with a support leg extending downward and the end of the driving portion of the actuator is pivotally connected to the support leg.

3. The lift chair of claim 2, wherein the accommodating room having a bottom closed by at least one plane, so that the support leg of the base is allowed to stand on a solid plane.

4. The lift chair of claim 2, wherein a sensor is deposited on the upper plate for detecting whether the user's bottom is in contact with the cushion.

* * * * *